United States Patent [19]

Ohmuro et al.

[11] 4,335,196

[45] Jun. 15, 1982

[54] ELECTROSTATIC IMAGE DEVELOPING AND TRANSFER METHOD USES SINGLE COMPONENT MAGNETIC DEVELOPER

[75] Inventors: Yuzo Ohmuro, Machida; Nin-ichi Kamogawa, Tokyo; Shigeru Uetake, Sayama; Yoshio Yamazaki, Hino, all of Japan

[73] Assignee: Konishiroku Photo Industry Co., Ltd., Tokyo, Japan

[21] Appl. No.: 211,344

[22] Filed: Nov. 28, 1980

Related U.S. Application Data

[63] Continuation of Ser. No. 25,783, Apr. 2, 1979, Pat. No. 4,295,427, which is a continuation of Ser. No. 829,795, Sep. 1, 1977, abandoned.

[51] Int. Cl.[3] ..... G03G 13/09

[52] U.S. Cl. ..... 430/122; 430/903; 430/106.6

[58] Field of Search ..... 430/122, 903, 106.6

[56] References Cited

U.S. PATENT DOCUMENTS 3,645,770 2/1972 Flint ..... 430/122

*Primary Examiner*—John D. Welsh

*Attorney, Agent, or Firm*—James E. Nilles

[57] ABSTRACT

An image-forming method using a developer comprising as the main component ferromagnetic and insulating toner particles. Said method comprises the steps of holding said developer on a delivery member by a magnetic force, causing the developer to tuft at the developing position and to fall in contact with an electrostatic latent image-supporting member, developing the electrostatic latent image and forming a toner image by the toner particles charged predominantly by mutual friction of the toner particles, and transferring the toner image onto a plain paper superposed on the electrostatic latent image-supporting member by electrostatic transfer means. Said developer has a specific resistance of at least $10^{14}\Omega$-cm and the potential decay ratio of the developed developer is lower than 50% as measured according to the method defined in the specification.

2 Claims, 3 Drawing Figures

ELECTROSTATIC IMAGE DEVELOPING AND TRANSFER METHOD USES SINGLE COMPONENT MAGNETIC DEVELOPER

REFERENCE TO RELATED CO-PENDING APPLICATIONS

This application is a continuation application from U.S. patent application Ser. No. 025,783 filed Apr. 2, 1979 and which issued as U.S. Pat. No. 4,295,427 on Mar. 31, 1981, and which in turn is a continuation application from U.S patent application Ser. No. 829,795, filed Sept. 1, 1977, now abandoned.

The present invention relates to a method for developing electrostatic images. More particularly, the invention relates to a developing method using a single-component developer composed solely of a toner as the main component and free of carrier particles.

The present invention further relates to a method for obtaining a final image by transferring a toner image formed by the above method onto a plain paper by electrostatic transfer. By the term "plain paper" used herein is meant an ordinary paper which has not been subjected to an electric insulating treatment, and an electrostatic recording paper having a resin coating thereon is excluded from the concept of the plain paper.

As the method customarily used for developing electrostatic images in copying machines utilizing the electrophotograhic process or electrostatic recording process, there are known the magnetic brush method, the cascade method and the method using a liquid developer. These known methods are excellent in the point that good images can be obtained, but they have defects commonly observed in two-component type developers, namely the fatigue of the carrier and the variation of the carrier-toner mixing ratio.

In contrast, methods using a single-component type developer composed solely of a toner as the main component and free of carrier particles are substantially free from the foregoing defects, and as such methods, there are known the touch-down method, the impression method and the induction development method using a conductive toner. However, each of these methods involves problems and disadvantages to be solved and eliminated, and they have hardly been practically worked commercially.

A magne-dry method which is included in the category of the induction development method is a method using an electrically conductive and ferromagnetic toner, and this method is detailedly illustrated in West German Patent Application Laid-Open Specification No. 2,313,297. This method has an advantage that electrostatic images charged both positively and negatively can be developed, but since the toner used is electrically conductive, the method has a defect that when the developed image is electrostatically transferred on a plain paper, the resulting image becomes obscure. When an electrostatic recording paper is used as the transfer paper, the sharpness is improved in the transferred image, but the cost is increased by use of such recording papers and there is brought about a defect not caused when a plain paper is used, namely a defect that writing with ink is difficult on paper.

It is therefore a primary object of the present invention to provide an image-forming method using a single-component type developer in which a sharp transferred image can be obtained on a plain paper while attaining the foregoing essential advantages of the developing method using a single-component type developer.

Other objects and features of the present invention will be apparent from the following detailed description made by reference to the accompanying drawings, in which.

The developer that is used in the present invention is composed solely of a toner as the main component and free of carrier particles, and it has ferromagnetic characteristics and an excellent insulating property. In the developing method of the present invention, a charge necessary for development is obtained by mutual friction of ferromagnetic and insulating toner particles. This developer is prepared by dispersing an appropriate amount of a ferromagnetic fine powder in a resin, kneading the dispersion under heating, cooling and pulverizing the kneaded mixture into fine particles and classifying them to collect a toner having a particle size range of 5 to 30$\mu$, or by dispersing a resin and a ferromagnetic fine powder in a solvent, granulating the dispersion by a spray drier of the rotary disc type and classifying the resulting particles to collect a toner having a particle size range of 5 to 30$\mu$. In order to attain good mutual friction in toner particles and perform electrostatic transfer of images onto plain papers in good conditions, it is necessary to select appropriate resin and ferromagnetic powder, select an appropriate charge-controlling agent and select appropriate mixing-ratio and preparation process, but these factors will be described in detail hereinafter.

Figure 1:
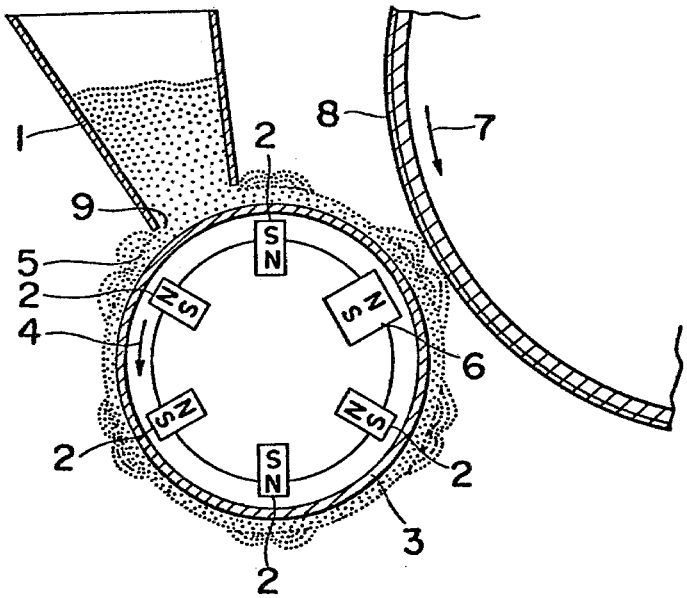
FIG. 1 is a front view of the developing apparatus to be used for working the developing method of the present invention.

In practising the developing method of the present invention, as shown in FIG. 1, such single-component developer composed solely of a toner as the main component is contained in a hopper 1 and a non-magnetic sleeve-like rotary member 3 acting as an outer cylinder for magnets 2 disposed and fixed below the opening of the hopper is rotated in a direction indicated by an arrow 4 to hold the toner on the rotary member 3 by a magnetic force and form a toner layer 5. This toner layer 5 is caused to fall at the position of a main magnet 6 in contact with an electrostatic latent image-supporting member 8 advancing in a direction indicated by an arrow 7, thereby to effect development. Of course, the toner used in this developing method has a specific resistance of at least $10^{14}$ $\psi$-cm and application of a charge on the toner from the outside, for example, application of corona discharge on the toner, is not conducted at all. In the developing method of the present invention, charges necessary for development are generated by mutual friction of toner particles while the toner layer 5 is turned with tufts of toner particles on the rotary member 3. According to this developing method, electrostatic latent images formed on a zinc oxide photosensitive material, an Se-PVK composite photosensitive material or a selenium photosensitive material can be developed. Further, a gradational image like that formed by an optical wedge can be reproduced by this developing method.

The fact that development is accomplished by mutual friction of insulating and ferromagnetic toner particles in the developing method of the present invention is supported by the following experimental results.

When a ferromagnetic and insulating toner prepared by incorporating a ferromagnetic fine powder into a resin according to the above-mentioned method was delivered in a developing apparatus by a magnetic force and caused to fall in contact with a selenium plate charged positively or negatively to effect development, a positive image could be obtained in each case. When the polarity of the toner particles on the developed image was measured, it was found that it was negative or positive and was reverse to the polarity of the latent image. Of course, as pointed out hereinbefore, the toner was electrically insulating and had a specific resistance of at least $10^{14}$ Ω-cm. All the toners mentioned hereinafter have such electrically insulating property.

When a negative electrostatic latent image was formed on a zinc oxide photosensitive plate and development was carried out by slightly weakening the magnetic force of the developing apparatus, not only the latent image area was developed, but also the toner particles adhered to a very narrow area along the contour of the latent image, namely the area in which an electric field of a polarity reverse to that of the latent image area. When amounts of charges on several toners developed were measured, it was found that the charge quantity was in the range from $2\times10^{-6}$ to $1.4\times10^{-5}$ coulomb per unit true volume (cubic centimeter). This value is slightly smaller than or substantially equal to the value of the toner charge quantity formed by friction of the carrier and toner in a two-component type developer. In simple experiments, it was confirmed that the charge quantity obtained was less than $10^{-9}$ coulomb/cm$^3$ when the same resin powder only was agitated.

When under the same conditions as developing conditions the toner layer on the developing apparatus was caused in frictional contact with a zinc oxide photosensitive plate which had not been subjected to corona discharge, it became charged positively or negatively depending on the surface property of the toner particles. Using a toner providing a negative charge by such frictional charging with a zinc oxide photosensitive material, the negatively charged latent image on the photosensitive material could be developed. When sufficient light rays were applied to extinguish the excessive charge on thus developed image, the charge polarity of the toner particles on the developed image could be measured and found to be positive. The toner particles were then moved by placing a magnet on the back face of the photosensitive material to frictionally charge the toner with the zinc oxide photosensitive material, and the polarity of the toner became negative again.

In view of the foregoing experimental results, it is believed that some toner particles are positively charged and other toner particles are negatively charged and that such charges are not brought about from the outside of the toner layer but they are predominantly generated by mutual friction of toner particles. When the toner particles were observed by an electron microscope under 1000 magnifications, it was found that a number of fine projections were present on the surfaces of particles and the size of the projection was in agreement with the size of the ferromagnetic fine powder incorporated in the toner particles. The ferromagnetic fine powder substantially exposed to the surfaces of the toner particles falls in frictional contact with the resin portion on the surfaces of other toner particles, and as a result, the ferromagnetic fine powder portion is negatively charged and the resin portion is positively charged. Accordingly, negatively charged points and positively charged points are present on the surfaces of toner particles. Collectively speaking, the toner particles include particles regarded as being positively charged and particles regarded as being negatively charged. In order to obtain the above-mentioned charge quantity, it is important not only to select an appropriate combination of a resin and a ferromagnetic fine powder to be used for formation of toner particles but also how to expose the ferromagnetic fine powder substantially to the surfaces of the toner particles. Further, a charge-controlling agent or other additive may be incorporated according to need. Specific examples of such toner particles are illustrated in, for example, Japanese Patent Application No. 99385/74.

An assistant such as silica may be added to improve the flowability of the toner.

As will be apparent from the foregoing illustration, the developing method of the present invention is a mutual friction method using an insulating, ferromagnetic toner and is different from the induction development method using an electrically conductive toner. Moreover, since the toner retains a true charge and even a gradational image can be reproduced, it will readily be understood that the method of the present invention can be distinguished from the polarization development method.

Although an image can be obtained by using a single-component developer comprising as the main component a ferromagnetic insulating toner as illustrated hereinbefore, in order to obtain a final image excellent in the sharpness on a plain paper by electrostatic transfer, problems are still left unsolved.

First of all, in an insulating toner comprising a ferromagnetic fine powder as the developer that is used in the present invention, even if the insulating property is defined by the specific resistance according to the conventional concept and a toner having a high specific resistance is prepared and used, a transferred image excellent in the sharpness cannot always be obtained. The relation between the specific resistance and the sharpness of an image electrostatically transferred on a plain paper, which was observed with respect to various sample toners, is shown in Table 1.

TABLE 1

| Sample No. | Specific Resistance Ω-cm | Sharpness | | | |
|---|---|---|---|---|---|
| 1 | $3.7\times10^{14}$ | | | | ΔX |
| 2 | $5.5\times10^{14}$ | | | | ΔX |
| 3 | $5.9\times10^{14}$ | | ○ | | |
| 4 | $1.6\times10^{15}$ | | | | ΔX |
| 5 | $4.2\times10^{15}$ | | ○ | | |
| 6 | $5.4\times10^{15}$ | | ○ | | |
| 7 | $6.1\times10^{15}$ | ◎ | ○ | | |
| 8 | $1.6\times10^{16}$ | | ○ | Δ | |
| 9 | $2.5\times10^{16}$ | | ○ | | |
| 10 | $2.7\times10^{16}$ | ◎ | | | ΔX |
| 11 | $3.1\times10^{16}$ | | | | X |
| 12 | $3.8\times10^{16}$ | ◎ | ○ | | |
| 13 | $7.1\times10^{16}$ | ◎ | ○ | | |
| 14 | $8.1\times10^{16}$ | | | Δ | |
| 15 | $3.0\times10^{17}$ | | ○ | | |
| 16 | above $3.0\times10^{17}$ | | ○ | | |
| 17 | above $3.0\times10^{17}$ | | | Δ | |
| 18 | above $3.0\times10^{17}$ | | ○ | | |
| 19 | above $3.0\times10^{17}$ | | | Δ | |

The sharpness was evaluated in an order of ◎, ○, Δ and X. A toner providing an image sharpness of Δ or higher can be practically employed.

In the above evaluation of the image sharpness, those samples, the image sharpness of which was substantially lost even in the as developed state before transfer because of coagulated toner particles readily formed in the development process using a single component developer comprising insulating ferromagnetic toner only, were of course at first eliminated.

The specific resistance was measured according to the following method.

A sample was substantially uniformly filled in a vessel of 5 mm thickness of an acrylic resin having a bottom plate composed of brass and side walls having a thickness of 5 mm in which the inner wall faces were sufficiently cleaned. Tapping was conducted 10 times with respect to each sample. To compensate the reduction of the thickness caused by compression, the sample was uniformly added so that the total thickness was 5 mm. Then, tapping was conducted 10 times again and a brass electrode was placed on the sample. An electric voltage of 100 V was applied under a pressure of 1 $Kg/cm^2$ and the measurement was conducted when the absorbing current was sufficiently decreased and the observed current was substantially constant. In the final stage of above measurement, the thickness of the sample was reduced to about 4 mm, and the reading of current value was ordinarily carried out when 15 to 30 minutes had passed from the start of application of the electric voltage.

In the actual development operation, the compressive force applied to the toner is predominantly an attracting force by the magnet. Accordingly, it is construed that in the actual development operation, the toner is used under a contact resistance higher than that at the above measurement.

We considered that the obscureness of image is not due to the simple resistance value of toner particles but due to the exposed state of the ferromagnetic fine powder on the surfaces of respective toner particles. More specifically, we considered that since the thickness of the toner image developed and transferred corresponds to 2 to 8 particles on the average at most if the particle size is about 10μ on the average, even if the toner has a high resistance measured according to the customary measurement method, in the practical operation delivery of charges is conducted between the ferromagnetic fine powder and the transfer paper or the like and charges are intruded into the particles along electrically weak points in the particles to render the image obscure. Accordingly, easiness of intrusion of charges was determined according to the following method.

Figure 2:
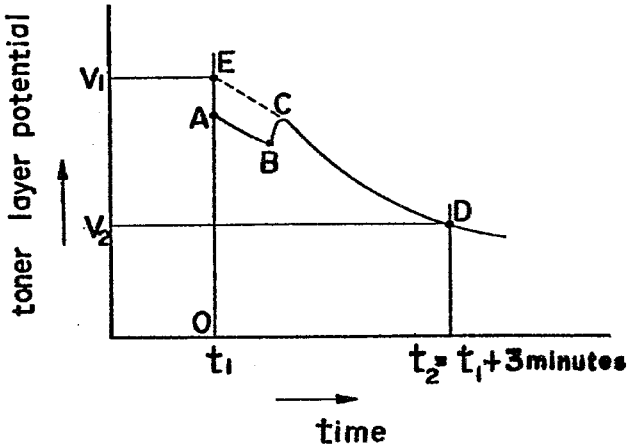
FIG. 2 is a graph showing the relation of the potential of the toner layer and the time.

Development was conducted on a predetermined area of a zinc oxide photosensitive paper and irradiation of light was instantaneously applied to such an extent that the latent image was not completely erased but substantially erased and a potential due to the charge of toner layer was observed. Then, irradiation was intercepted and a light-transmitting type potentiometer was placed (point A in FIG. 2, the time being designated as $t_1$) to record the dark decay for a short time (within 1 minute).

When the entire surface was then irradiated at point B, since the residual latent image was completely erased, the potential was elevated to point C and then continued to decrease. If a curve including points A, B, C and D was thus drawn, a line parallel to the segment A-B was drawn from point C and the point where this parallel line crossed the time $t_1$ was designated as point E. The potential $V_1$ corresponds to the initial potential attained when there is present no latent image and the decay of the potential is not substantially caused by irradiation of light. If the potential at the time $t_2$ when 3 minutes had passed from $t_1$ is designated as $V_2$, the degree of penetration of charges into the toner layer can be expressed as follows:

$$(V_1 - V_2)/V_1 \times 100\ (\%)$$

In the practical operation, intrusion of charges from a transfer paper is important. However, we determined the degree of intrusion of charges according to the above-mentioned method as the substitutive method. For example, the measurement was conducted at a light intensity of 200 to 300 luxes for an instantaneous exposure time of about 0.5 to about 2 seconds. Of course, the instantaneous exposure time should be changed depending on the thickness of the toner layer and other factors. At any rate, it is important that a curve including points A, B, C and D, namely the peak value C, should be obtained. It also is important that the height of segment B-C should be as small as possible as compared with the height of segment O-A. When the quantity of light of instantaneous exposure before setting of the transmitting type potentiometer is small and point A is too low and the rise of the potential after setting of the potentiometer is great, namely the distance between points B and C is long, the peak point C is sometimes not obtained, because the advancing direction of light is limited under irradiation in the state where the transmitting potentiometer is set on the sample or because erasing of the latent image by irradiation and the intrusion of charges into the toner layer are simultaneously caused. Of course, a toner having a potential decay of zero is out of the question.

In this measurement, it is important that rays for the first instantaneous irradiation should be scattered rays. We used a fluorescent lamp for interior illumination as the light source for the measurement. It was found that the influence of the intensity of light is not so great.

The potential decay ratio is not affected directly by the thickness of toner layer, because $(V_1 - V_2)/V_1 \times 100$ (%) representing the degree of penetration of charges into the toner layer means potential decay ratio. However, it is necessary to specify the thickness of the toner layer to be placed on the zinc oxide photosensitive material, because the potential decay ratio is liable to be reduced a little when a thick toner layer is placed on the zinc oxide photosensitive material.

The thickness of the toner layer is determined by measuring the weight per unit area of the toner layer and dividing the measured value by the specific gravity of the toner. The thus calculated value indicates the thickness of the toner in plate form having a void ratio of zero. Therefore, the thickness is called as calculated thickness.

The relation between the thickness of toner layer and the potential due to charges of the layer in the strict sense is that the measured value of potential represents the integrated value of potentials due to charges on the toner layers of varied thickness on the minute portions of the photosensitive material, and the mean value in thickness of the toner layer is not concerned. However, it is impossible practically to determine the thickness of each toner layer on the minute portions of the photosensitive material. Further, as described above, the potential decay ratio is to be measured, so that said "calculated thickness" can be adopted, rather than the thickness of the toner layer is determined strictly. As described hereinafter, in fact, the measurement of the potential decay ratio under the condition that the "calculated thickness" is determined in a certain range is considerably well in agreement with the obscureness of image.

For example, in case of a toner layer composed of toner particles having an average particle size of 10μ and a recipe A, which is found by a stereoscopic microscope to consist of 4 to 5 particles in the thickness direction, the thickness is calculated as 8.04μ, and in case of a layer consisting of 2 to 3 particles in the thickness direction, the thickness is calculated as 5.87μ with respect to a recipe B and in case of a layer consisting of two particles, the thickness is calculated as 3.11μ with respect to a recipe C. Thus, it must be noted that the "calculated thickness" is smaller than the size of one particle.

The thickness of the toner layer that is necessary for measuring the potential decay should be equal to the thickness of the toner layer placed on the photosensitive material that may be obtained by developing an electrostatic latent image of high optical density solid area under such a condition that an optimum image can be obtained by using the same toner in a copying machine.

It is meaningless to determine the potential decay using the toner layer of a thickness which is apparently different from that of actually used in copying. The "calculated thickness" of the toner layer for obtaining actually an image of good quality is within a range of 3 to 11μ.

The above-mentioned measurement conditions and procedures are summarized as follows:

1. On a zinc oxide photosensitive material is placed a toner layer of a thickness approximately equal to a thickness of a toner layer placed on the photosensitive material that may be obtained by developing an image of high optical density solid area under such a condition that an optimum image can be obtained by using a toner to be measured in a copying machine.

The developing device and the conditions used in the measurement are the same with that illustrated in Example 1 given hereinafter.

2. Scattered light is applied so that the peak C is obtained and the height of the segment BC is smaller than that of the segment OA. In the actual measurement, light of 200 to 300 luxes is applied by a fluorescent lamp, and irradiation time is changed in the range of 0.5 to 3 seconds depending on the thickness.

3. When about 2 to about 3 seconds have passed from interception of light, a light-transmitting type potentiometer is placed on the sample to obtain the point A, and after passage of 1 minute, namely at the point B, irradiation is conducted for more than 3 minutes by using the same light source.

4. From the potential $V_2$ obtained after lapse of 3 minutes and an extrapolation line from the point C which is parallel to the segment AB, the value $V_1$ is determined, and the easiness of permeation of charges into the toner layer, which is designated for simplicity as "voltage leakage", is calculated from the following formula:

$$(V_1 - V_2)/V_1 \times 100\ (\%)$$

5. The "calculated thickness" of the toner layer is within a range of 3 to 11μ.

With respect to samples shown in Table 1, the "voltage leakage" was determined and the obtained value was contrasted to the obscureness at the transfer step, namely the sharpness of the transferred image, to obtain results shown in Table 2.

TABLE 2

| Sample No. | Voltage Leakage (%) | Sharpness |
|---|---|---|
| 1 | 73.4 | ΔX |
| 11 | 55.4 | X |
| 4 | 55.1 | ΔX |
| 10 | 52.0 | ΔX |
| 2 | 50.8 | ΔX |
| 17 | 47.2 | Δ |
| 14 | 47.0 | Δ |
| 8 | 31.6 | ○ Δ |
| 19 | 29.5 | Δ |
| 18 | 17.4 | ○ |
| 13 | 15.8 | ◎ ○ |
| 3 | 12.7 | ○ |
| 7 | 11.5 | ◎ ○ |
| 16 | 9.9 | ○ |
| 15 | 4.5 | ○ |
| 12 | 4.4 | ◎ ○ |
| 6 | 2.8 | ○ |
| 5 | 2.3 | ○ |
| 9 | 1.9 | ◎ |

From the above results, it is seen that the "voltage leakage" is considerably well in agreement with the sharpness, though no definite agreement is observed between the specific resistance and the sharpness as pointed out hereinbefore.

The reason why the "voltage leakage" is not proportional to the specific resistance is indefinite. It is construed that the particle size distribution and flowability of the toner when it is packed between the electrodes for measurement of the resistance may have influences on measurement results. When the measurement of the resistance was conducted on a sample molded into a tablet by application of a pressure of 100 Kg/cm$^2$, obtained results had no corresponding relation to the sharpness.

Accordingly, it was confirmed that as a factor having a direct relation to the sharpness or obscureness in the transferred image, the "voltage leakage" approximating the degree of intrusion of charges at the transfer step should be determined according to the above-mentioned method.

In view of the foregoing, it will readily be understood that in a single-component toner comprising a ferromagnetic fine powder, which is used for formation of an image on a plain paper by electrostatic transfer, mere limitation of the specific resistance is insufficient and the toner must be specified also by the "voltage leakage". From the results shown in Table 2, it is apparent that the toner is required to have a "voltage leakage" lower than 50%.

In order to obtain insulating and ferromagnetic toner particles for use in by mutual friction development, which have a low "voltage leakage", it is first of all necessary to reduce the content of the ferromagnetic fine powder. However since application of a bias voltage is difficult in development using an insulating single-component toner and a bias magnetic force is applied instead, namely since a magnetic field is caused to act on the ferromagnetic fine powder in the toner particles in opposition to the force of an electrostatic latent image acting on charges, it must be noted that it is not permissible to reduce the content of the ferromagnetic fine powder below a certain critical level. Even if 60 parts by weight of the ferromagnetic fine powder is used with 40 parts by weight of resin, it is possible to recuce the "voltage leakage" if appropriate resin and solvent are selected. In short, it is preferred to select a resin having a covering property appropriately chosen depending on the kind of the ferromagnetic fine powder. When a charge-controlling agent is used better results are obtained by the use of a polymeric charge-controlling agent including a dye.

Moreover, a toner having a low "voltage leakage" can also be prepared by selecting an appropriate preparation process, which will be understood from Examples given hereinafter.

Toners we first prepared by way of trial had a good adaptability to by mutual friction development, but in many cases, the resulting transferred images were obscure. Some instances of these trial product toners will now be described.

COMPARATIVE EXAMPLE 1

| | |
|---|---|
| Epoxy resin | 35 parts |
| Ferromagnetic powder (triiron tetraoxide) | 65 parts |

The above components were incorporated and dispersed in a mixed solvent consisting of 70 parts of toluene and 30 parts of acetone, and the resulting dispersion having a solid content adjusted to 60% was treated in a porcelain ball mill for 32 hours. Then, the above mixed solvent was further added to the dispersion to adjust the solid content to 20%, and granulation was conducted according to a spray dry method using a rotary disc. The so obtained black toner particles having an average size of about 10μ was used for development by using an apparatus illustrated in Example 1 given hereinafter, and then, the image transfer was carried out. The image developed on a photosensitive plate was a very good gradational image, but the transferred image was very obscure. The "voltage leakage" of the toner prepared in this Comparative Example was 75.6%.

COMPARATIVE EXAMPLE 2

| | |
|---|---|
| Epoxy resin | 40 parts |
| Ferromagnetic powder (triiron tetraoxide) | 60 parts |
| Dye (Nigrosine SSB manufactured by Orient Kagaku) | 2 parts |

From the above components, a toner having an average particle size of 10μ was prepared in the same manner as described in Comparative Example 1. The developed image was a good gradational image, but the transferred image was obscure. The "voltage leakage" of the toner was 52%.

The present invention will now be described by reference to the following Examples.

EXAMPLE 1

| | |
|---|---|
| Resin (Piccolastic C-125 manufactured by Pennsylvania Industrial Chemical Corp.) | 40 parts |
| Ferromagnetic powder (triiron tetraoxide) | 60 parts |

-continued

| | |
|---|---|
| Dye (Nigrosine SSB) | 2 parts |

In the same manner as described in Comparative Examples 1 and 2, the above components were incorporated and dispersed in a mixed solvent consisting of 70 parts of toluene and 30 parts of acetone to form a dispersion having a solid content of 60% by weight, and the dispersion was treated for 32 hours in a porcelain ball mill and the mixed solvent was further added to adjust the solid content to 20% by weight. Granulation was carried out according to a spray dry method using a rotary disc. The resulting toner particles had an average particle size of about 10μ and a particle size distribution in the range of 3 to 30μ. In order to improve the flowability, silica was added to the toner in an amount of 0.3% by weight based on the toner. The so prepared toner was filled in a hopper 1 of the apparatus shown in FIG. 1. A sleeve 3 composed of brass was rotated, and the toner was withdrawn from the hopper 1 and retained on the sleeve 3 by the magnetic force of magnets 2. The thickness of the toner layer 5 on the sleeve 3 was adjusted to 1 mm. The toner layer thickness could be set by controlling the distance between the sleeve 3 and the lower end 9 of the hopper 1. The magnetic flux density of a fixed developing magnet 6 on the sleeve 3 was adjusted to 900 gauss and the distance between a photosensitive material 8 and the sleeve 3 in the developing zone was set to 1.4 mm. This developing apparatus is represented by reference numeral 10 in FIG. 3. In the apparatus shown in FIG. 3, a belt 13 is laid out on drums 11 and 12, and a zinc oxide photosensitive material 14 was disposed on the belt 13. A charging device 15 and an optical slit 15' were moved in a direction indicated by arrow 15'' to form an electrostatic latent image having a maximum potential of 350 V. Then, the drum 11 was rotated in a direction indicated by arrow 16 and the sleeve 3 was rotated in a direction indicated by arrow 4 to effect development. A plain paper 18 was set on a transfer paper receiver 17, and paper feed rollers 19 and 20 were rotated synchronously with the movement of the zinc oxide photosensitive plate 14 and the plain paper 18 was fed along paper feed guide plates 21. On a transfer electrode 22, the plain paper 18 was contacted closely with the photosensitive plate 14 and the toner was transferred by corona discharge. The plain paper 18 was separated at a separating head 23 and the toner was thermally fixed by a fixing device 24 to obtain a final image, which was a good gradational image free of obscureness.

The "voltage leakage" of the toner prepared and used in this Example was 5.2%. In this Example, the transfer device used could be substituted by an electrostatic transfer roller.

EXAMPLE 2

| | |
|---|---|
| Resin (Piccolastic C-125) | 40 parts |
| Ferromagnetic powder (triiron tetraoxide) | 60 parts |
| Dye (Nigrosine SSB) | 2 parts |

In the same manner as described in Example 1, a toner was prepared from the above components by using instead of the solvent used in Example 1 (1) a mixed solvent consisting of 10 parts of ethyl alcohol and 90 parts of dichloroethane or (2) a mixed solvent consisting of 10 parts of methyl cellosolve and 90 parts of ethyl acetate. Other preparation conditions were quite the same as in Example 1. The resulting toner having an average particle size of 10μ was mixed with 0.3% by weight of silica. When the "voltage leakage" was measured, it was found that the voltage leakage of the toner prepared by using the mixed solvent (1) was 1.0% and that of the toner prepared by using the mixed solvent (2) was 19.6%.

When the developing and transfer operations were carried out by using these two toners and the apparatus described in Example 1, sharp transferred images were obtained.

EXAMPLE 3

| | |
|---|---|
| Epoxy resin | 40 parts |
| Styrene (90 mole %)/dimethylaminoethyl methacrylate (10 mole %) copolymer | 2 parts |
| Ferromagnetic powder (triiron tetraoxide) | 60 parts |

The dispersing and granulating treatments were carried out in the same manner as described in Example 1 by using a mixed solvent consisting of 70 parts of toluene and 30 parts of acetone. This Example corresponds to a modification of Comparative Example 2 in which 2 parts of the above-mentioned copolymer was used as the charge-controlling agent instead of 2 parts of Nigrosine SSB used in Comparative Example 2. The "voltage leakage" of the toner prepared in this Example was 4.4%. Of course, a good gradational image was obtained by development and an image transferred onto a plain paper was sharp. In this Example, there was attained not only a simple effect expected from change of the dye to the polymeric charge-controlling agent but also a peculiar effect of the styrene (90 mole %)/dimethylaminoethyl methacrylate (10 mole %) copolymer used in combination with the epoxy resin, namely an effect of improving the degree of covering the ferromagnetic powder. When conditions were slightly changed in this Example, a toner having a reduced "voltage leakage" was obtained in each case. One instance is illustrated in the following Example 4.

EXAMPLE 4

To the components used in Example 3 was added 2 parts of carbon black. Other preparation conditions were quite the same as in Example 3. The resulting toner was more blackish than the toner obtained in Example 3. The voltage leakage was 17.4%, and increase of the voltage leakage was relatively small in spite of the fact that carbon black was incorporated.

EXAMPLE 5

| | |
|---|---|
| Epoxy resin | 40 parts |
| Ferromagnetic powder (triiron tetraoxide) | 60 parts |
| Dye (Nigrosine SSB) | 1.5 parts |
| Plasticizer (dioctyl phthalate) | 3 parts |

The above components were mixed, molten and kneaded by a compression kneader. The kneaded mixture was cooled, roughly pulverized and then finely pulverized by a jet mill.

The pulverized toner was blown into a spray drier by using an air jet nozzle and was instantaneously treated by hot air streams maintained at 250° C. The resulting toner was classified by a zigzag classifier to collect particles having an average particle of 10μ. The resulting toner was mixed with 0.2% by weight of silica as a flowability-improving assistant. By using the so obtained toner, development and image transfer were carried out in the same apparatus as described in Example 1. A good gradient image free of obscureness was obtained. The voltage leakage of the toner was 36%.

EXAMPLE 6

| | |
|---|---|
| Epoxy resin | 50 parts |
| Ferromagnetic powder (triiron tetraoxide) | 50 parts |
| Dye (Nigrosine SSB) | 1.5 parts |
| Plasticizer (dioctyl phthalate) | 3 parts |

A toner was prepared from the above components in the same manner as described in Example 5. The resulting toner having an average particle size of 10μ was mixed with 0.2% by weight of silica. By using the so obtained toner, development and image transfer were carried out in the same apparatus as described in Example 1. A sharp gradational image was obtained. The voltage leakage of the toner was 23%.

EXAMPLE 7

| | |
|---|---|
| Styrene (70 mole %)/butyl methacrylate (30 mole %) copolymer resin | 50 parts |
| Ferromagnetic powder (triiron tetraoxide) | 50 parts |
| Dye (Oil Black) | 2 parts |
| Pigment (carbon black) | 1.5 parts |

The above components were pulverized and dispersed by a centrifugal mixer, and sufficiently mixed, molten and kneaded by two heated rolls. The kneaded mixture was cooled, roughly pulverized and then finely pulverized by a hammer mill. The pulverized product was blown into a spray drier by using an air jet nozzle and instantaneously treated by hot air streams maintained at 270° C. The resulting toner was classified by a zigzag classifier to obtain a toner having an average particle size of about 10μ.

The so obtained toner was mixed with 0.1% by weight of silica, and in the same manner as described in the foregoing Examples, a transferred image was obtained on a plain paper. The obtained image was a sharp gradient image. The "voltage leakage" of the toner was 4%.

EXAMPLE 8

| | |
|---|---|
| Styrene (90 mole %)/diethylaminoethyl methacrylate (10 mole %) copolymer resin | 50 parts |
| Ferromagnetic powder (triiron tetraoxide) | 50 parts |
| Pigment (carbon black) | 2 parts |

The above components were mixed, molten and kneaded by a compression kneader directly without performing preliminary mixing. The kneaded mixture was cooled, pulverized, blown into a spray drier by an air jet nozzle and granulated by hot air streams maintained at 250° C. Then, the granules were classified by a zigzag classifier to obtain a toner having an average particle size of 10μ. The toner was mixed with 0.2% by weight of silica as a blowability-improving assistant. Development and image transfer were carried out in the same manner as in the preceding Examples to obtain a sharp gradational image. The "voltage leakage" of the toner was found to be substantially zero.

It is now added that the fact that the "voltage leakage" is zero means that the decay of the potential is zero in the above-mentioned "voltage leakage" measuring method and the fact does not indicate that the ferromagnetic powder is completely coated. By the confirming experiments mentioned in pages 7–9 in this specification, it was confirmed that also in case of the toner obtained in this Example, development was accomplished by mutual friction of toner particles.

EXAMPLE 9

| | |
|---|---|
| Styrene (95 mole %)/dimethyl methacrylate (5 mole %) copolymer | 40 parts |
| Ferromagnetic powder (triiron tetraoxide) | 60 parts |

The above components were directly kneaded by a compression kneader, and the kneaded mixture was pulverized, blown in a spray drier by an air jet nozzle and granulated under heated by hot air streams maintained at 180° C. The granulated product was mixed with 0.7% of silica and classified by a zigzag classifier to obtain a toner having an average particle size of about 10μ and a particle size distribution ranging from 4μ to 30μ.

Figure 3:
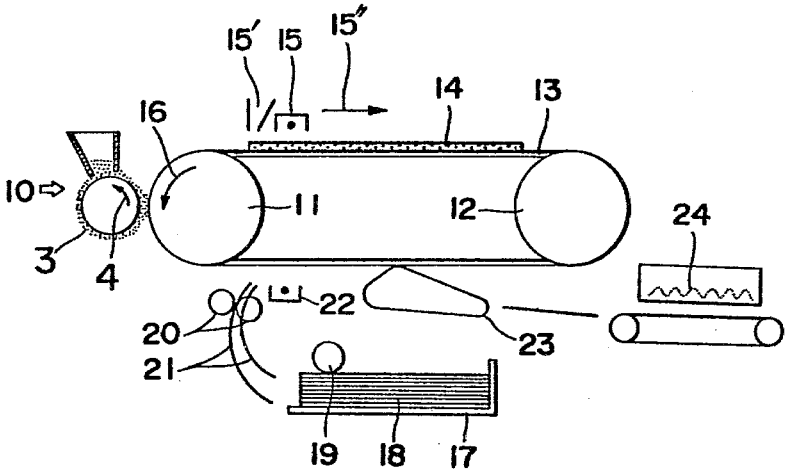
FIG. 3 is a front view illustrating the copying apparatus.

Development and image transfer were carried out by using the apparatus shown in FIG. 3. A composite Se/PVK photosensitive material was used instead of zinc oxide as the photosensitive material 14. A scorotron having a stretched grid was used as the charging device 15 to adjust the charging potential on the photosensitive material. The distance between the sleeve 3 of the developing device and the Se/PVK photosensitive material travelling along the drum 11 was changed to 1.25 mm, and the main magnet was slightly more inclined to the rotation direction of the sleeve 3 than in the case of the zinc oxide photosensitive material. In a developed image obtained under the above conditions, the characteristic of mutual friction was conspicuously manifested and a small quantity of the toner adhered to a reverse polarity electric field region on the peripheral contour of the latent image area. Thus, the obtained image was very excellent. Since the Se/PVK layer was negatively charged, the toner adhering to the latent image area had a positive polarity and the toner adhering to the peripheral contour area had a negative polarity. The so obtained image was then transferred onto a plain paper by the transfer device 22 (negative discharge). Since only the positive image of the positive polarity toner was transferred, an excellent gradient image was obtained. The image was very excellent in the sharpness and was free of obscureness. The "voltage leakage" of the toner was 1.9%.

As will be apparent from the foregoing illustration, in the present invention, since development is accomplished by mutual friction of particles of an insulating single-component toner containing a ferromagnetic fine powder and a "voltage leakage" lower than 50% and the developed image is transferred onto a plain paper, it is possible to form a sharp image on a plain while retaining advantages of the development using a single-component developer.

What is claimed is:

1. An image forming method whereby a single-component type developer is employed to transfer a sharp image to plain paper comprising the steps of:

providing a developer comprising ferromagnetic and insulating toner particles and free of carrier particles, and having a volume specific resistance of at least $10^{14}$ Ωcm and a potential decay ratio of less than 50% when measured by (1) forming on zinc oxide photoconductive material a layer of the developer of a predetermined thickness, (2) erasing the electrostatic latent image on said photoconductive material which served to form said layer, so as to reveal the potentials of said layer, (3) measuring the potentials $V_1$ and $V_2$ of said layer after one minute from dark decay and after three minutes from the succeeding light decay, respectively, and (4) determining the decay ratio on the basis of $(V_1-V_2)/V_1\times 100(\%)$;

electrostatically charging said toner particles;

contacting said charged toner particles with photoconductive material on which an electrostatic latent image is provided in order to develop said latent image;

and transferring the developed image onto plain paper.

2. A method according to claim 1, wherein said toner particles are charged by effecting mutual friction between said toner particles.

* * * * *